US012318833B2

(12) United States Patent
Araki

(10) Patent No.: US 12,318,833 B2
(45) Date of Patent: Jun. 3, 2025

(54) APPARATUS FOR PRODUCING BRANCH STRUCTURE IN METAL PIPE, AND METHOD FOR PRODUCING BRANCH STRUCTURE IN METAL PIPE

(71) Applicant: Araki Technical & Research Co., Ltd, Yokohama (JP)

(72) Inventor: Masanori Araki, Yokohama (JP)

(73) Assignee: Araki Technical & Research Co., Ltd, Yokohama (JP)

( * ) Notice: Subject to any disclaimer, the term of this patent is extended or adjusted under 35 U.S.C. 154(b) by 0 days.

(21) Appl. No.: 17/928,361

(22) PCT Filed: Dec. 13, 2021

(86) PCT No.: PCT/JP2021/045805
§ 371 (c)(1),
(2) Date: Nov. 29, 2022

(87) PCT Pub. No.: WO2022/138282
PCT Pub. Date: Jun. 30, 2022

(65) Prior Publication Data

US 2023/0311194 A1 Oct. 5, 2023

(30) Foreign Application Priority Data

Dec. 22, 2020 (JP) ..... 2020-212411

(51) Int. Cl.
*B21D 39/04* (2006.01)

(52) U.S. Cl.
CPC ..... *B21D 39/04* (2013.01)

(58) Field of Classification Search
CPC ..... B21D 39/04; B21C 37/292; B21C 37/29
See application file for complete search history.

(56) References Cited

U.S. PATENT DOCUMENTS 4,676,088 A 6/1987 Okada et al.
5,829,468 A 11/1998 Watanabe et al.

FOREIGN PATENT DOCUMENTS

EP 1332807 A1 * 8/2003 ..... B21C 37/292
GB 774927 A 5/1957
(Continued)

OTHER PUBLICATIONS

Hinataya, Hiroshi; JP-59013530-A Machine Translation (Year: 1984).*
(Continued)

*Primary Examiner* — Lee A Holly
(74) *Attorney, Agent, or Firm* — Amster, Rothstein & Ebenstein LLP

(57) ABSTRACT

The apparatus for producing a branch structure has: a die 10 having a spherical shape, and having a long diameter A1 and a short diameter B1 that is shorter than the long diameter A1; and an extraction jig 20 that can be connected to the die 10. At a time of removal, by the extraction jig 20 connected to the die 10, of the die 10 having been inserted into a pipe 30 in which a flanged portion 32 is to be formed, first flanging is performed by the die on a pilot hole 31 that is formed at a branch portion formation position in the pipe 30 and that runs radially through a body of the pipe 30, and then the extraction jig 20 causes the removed die 10 to rotate by a predetermined angle about a central axis, whereupon second flanging is performed on the pilot hole 31, from outside the pipe 30, by the rotated die 10.

5 Claims, 23 Drawing Sheets

(56) References Cited

FOREIGN PATENT DOCUMENTS

| | | | | |
|---|---|---|---|---|
| JP | S30-8916 | B1 | | 12/1955 |
| JP | S57-115921 | A | | 7/1982 |
| JP | S57199527 | A | | 12/1982 |
| JP | 59013530 | A | * | 1/1984 |
| JP | S59013530 | A | | 1/1984 |
| JP | S62292219 | A | | 12/1987 |
| JP | 2016-209889 | A | | 12/2016 |

OTHER PUBLICATIONS

International Search Report and Written Opinion dated Feb. 22, 2022 issued in PCT International Application No. PCT/JP2021/045805 (with English language translation of International Search Report attached).

Supplementary European Search Report issued Sep. 27, 2024 in European Patent Application No. 21910431.

* cited by examiner

[FIG. 1]
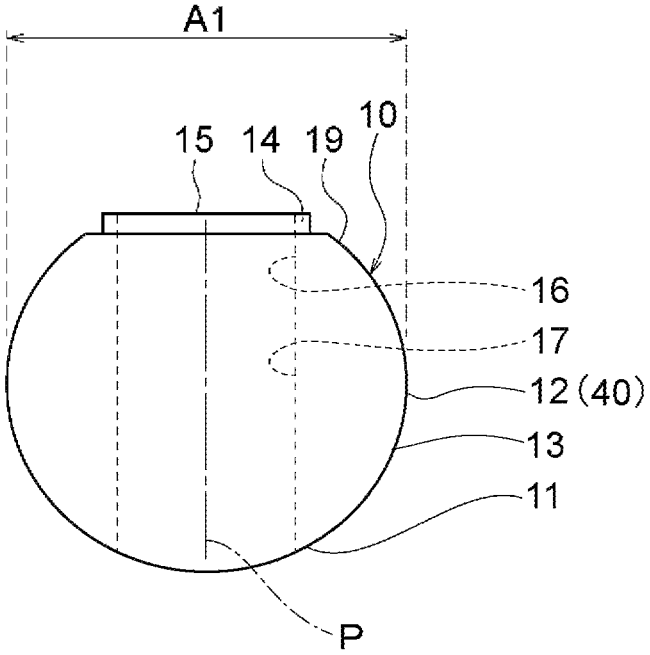

[FIG. 2]
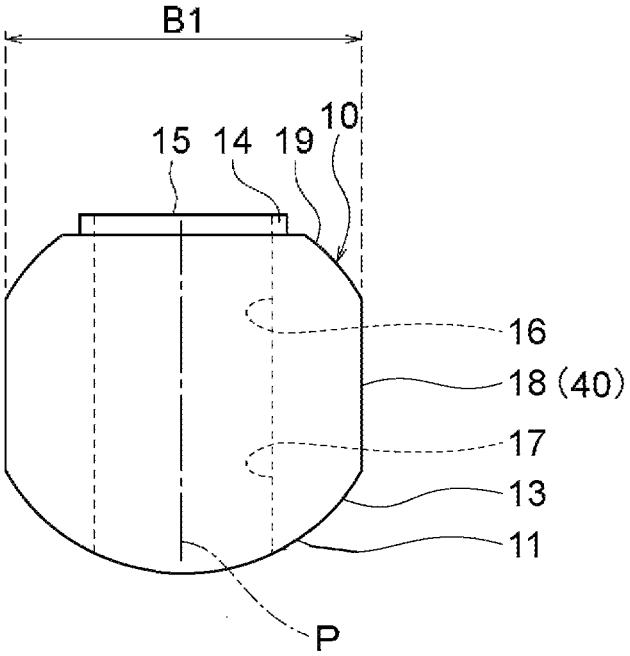

[FIG. 3]
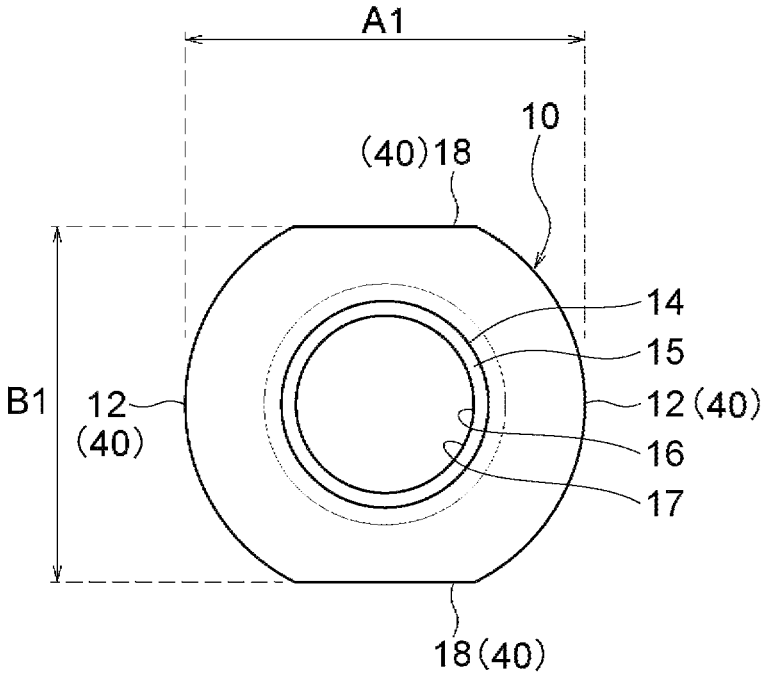

[FIG. 4]
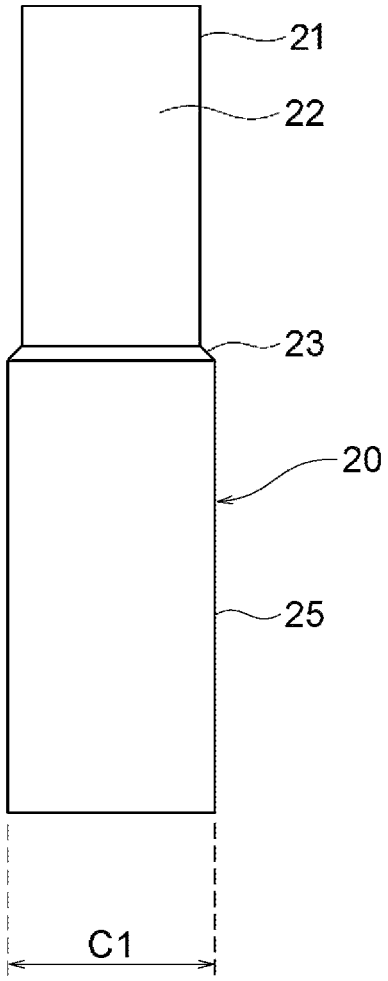

[FIG. 5]
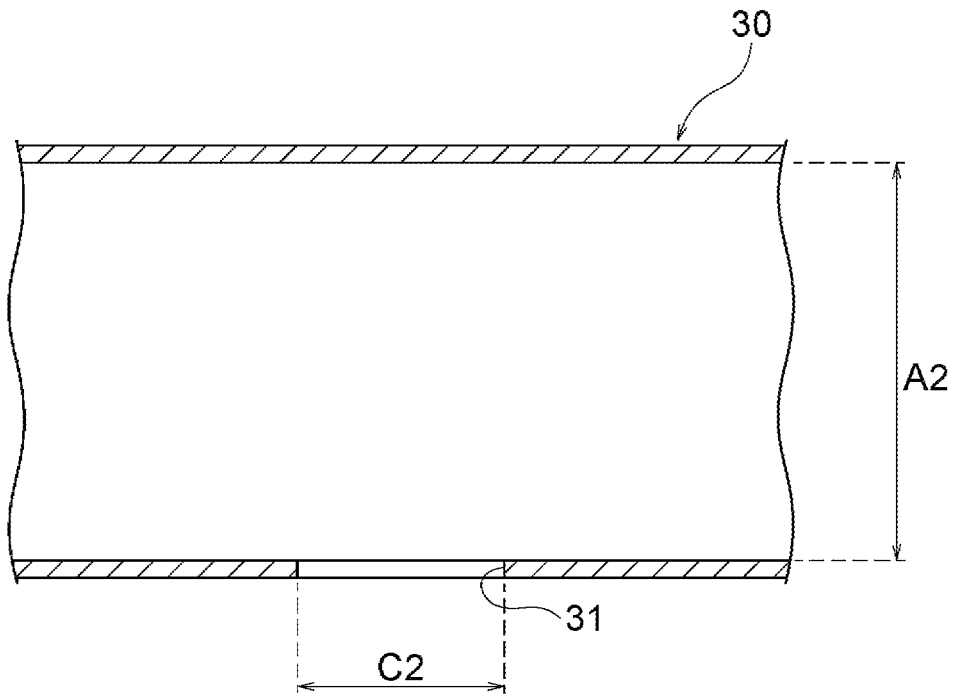

[FIG. 6]
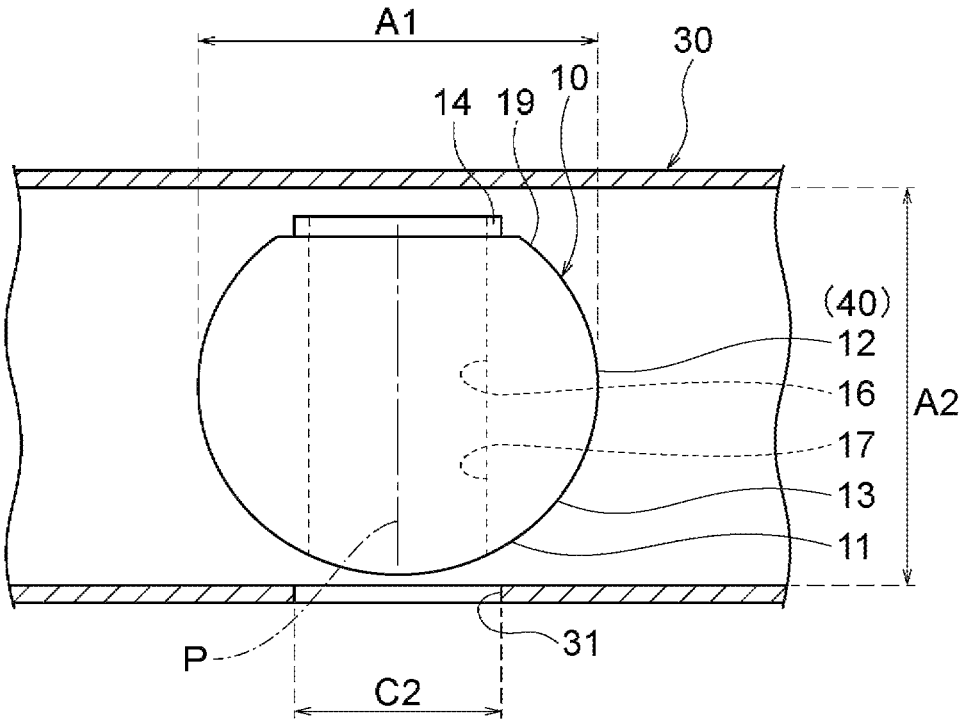

[FIG. 7]
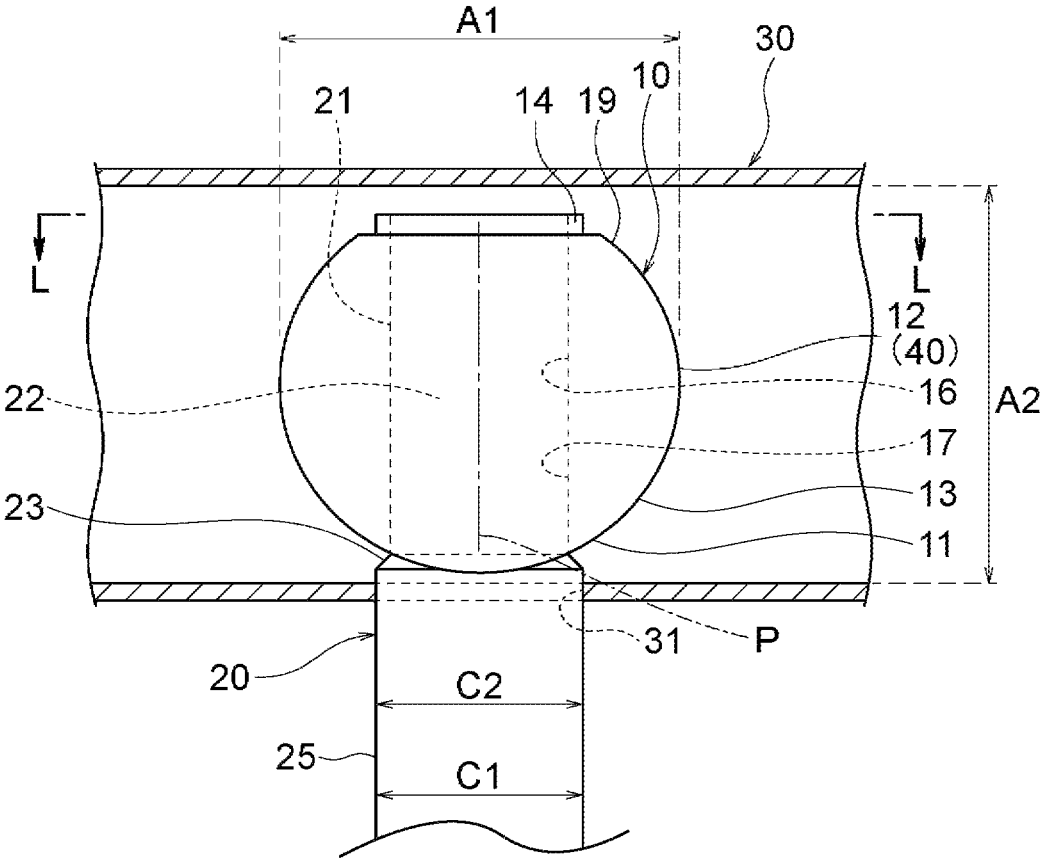

[FIG. 8]
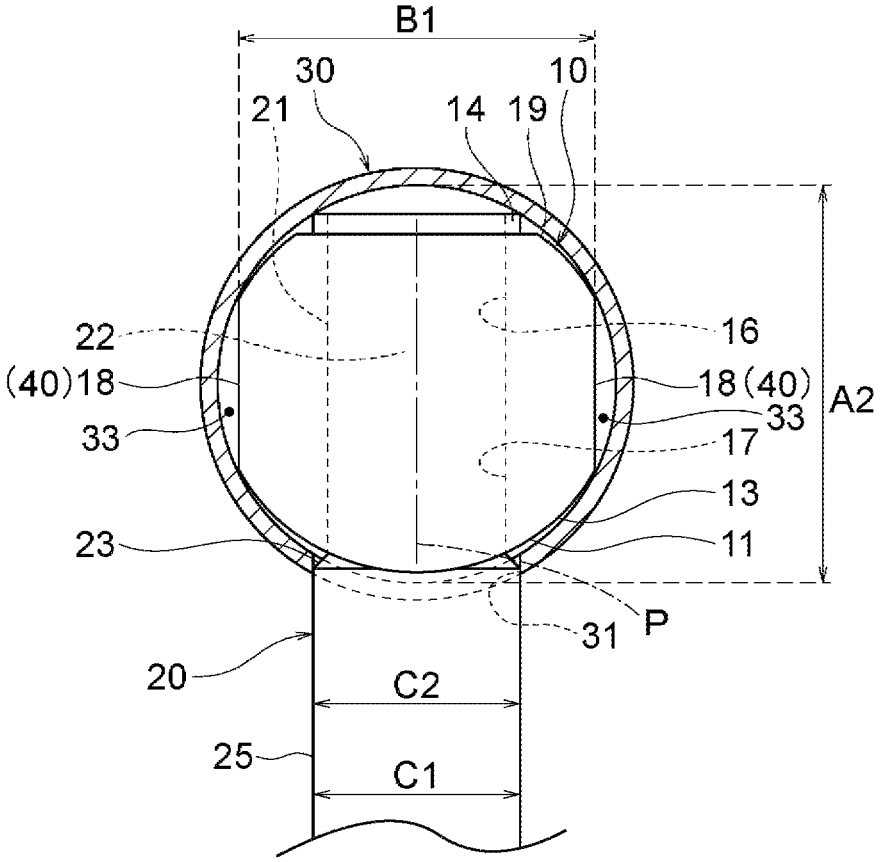

[FIG. 9]
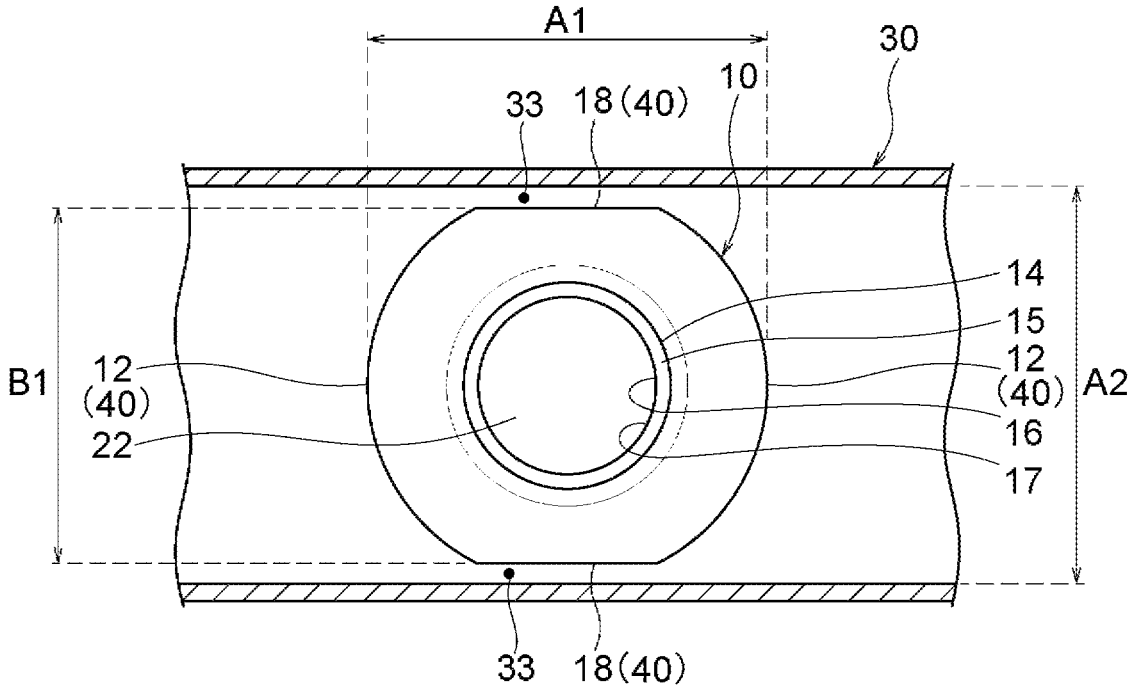

[FIG. 10]
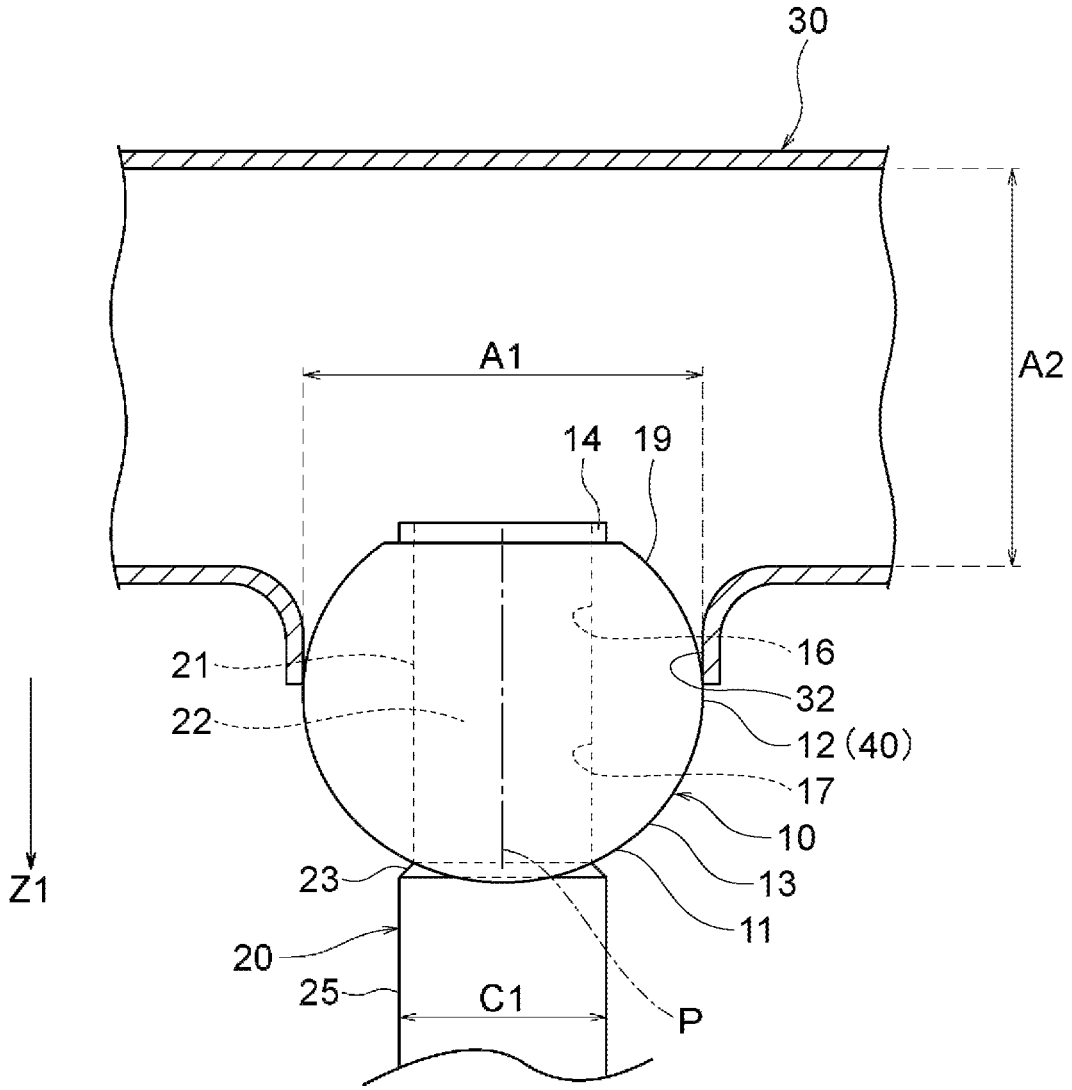

[FIG. 11]
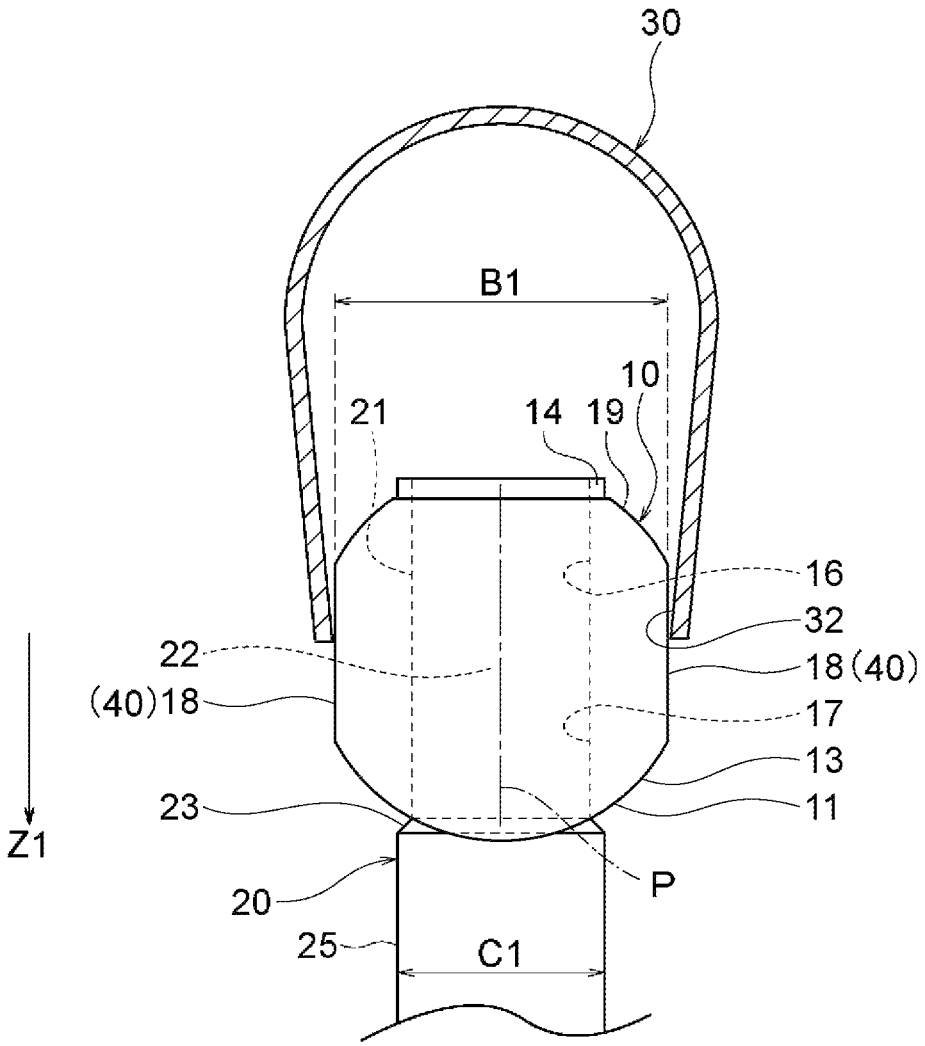

[FIG. 12]
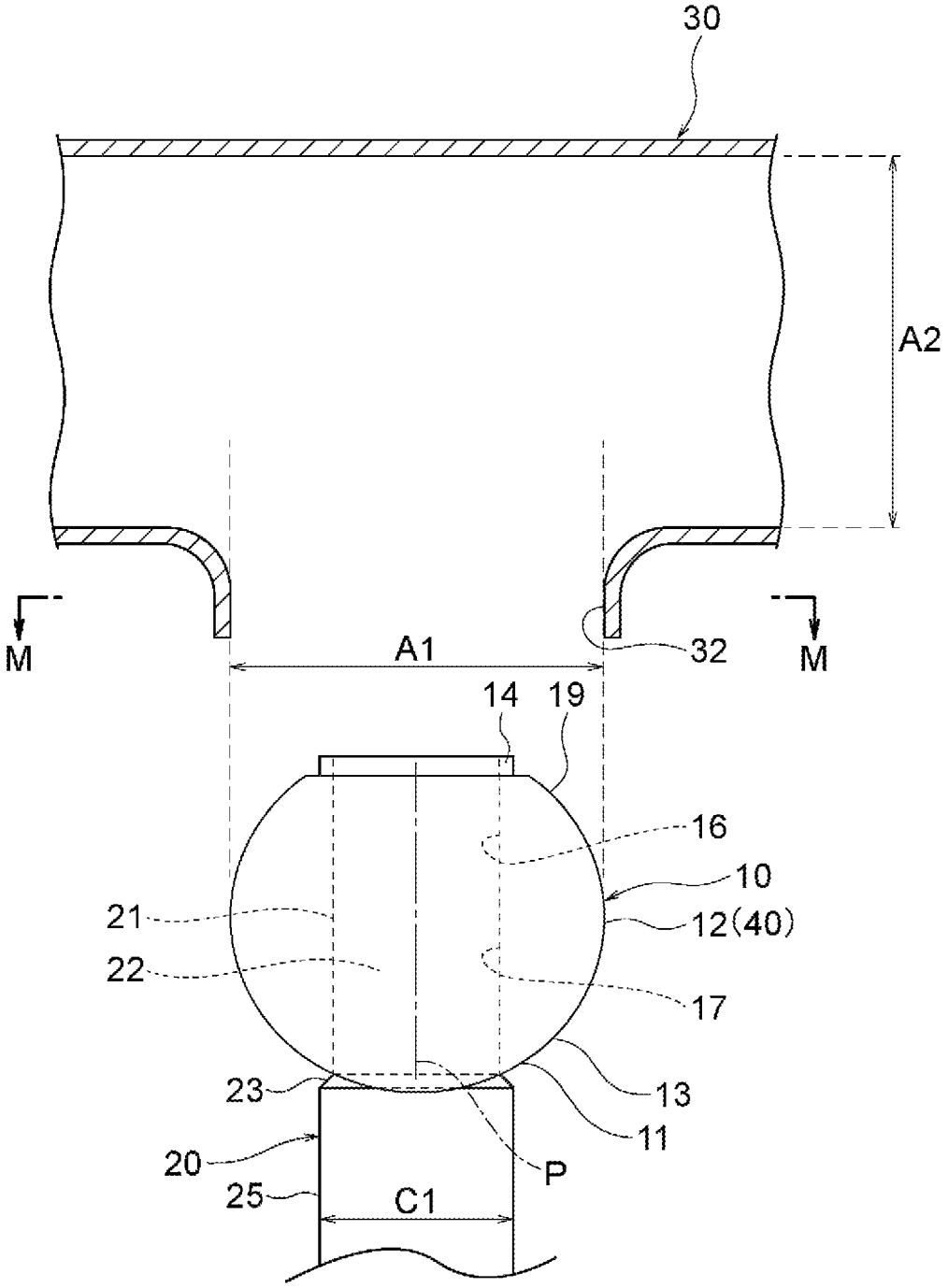

[FIG. 13]
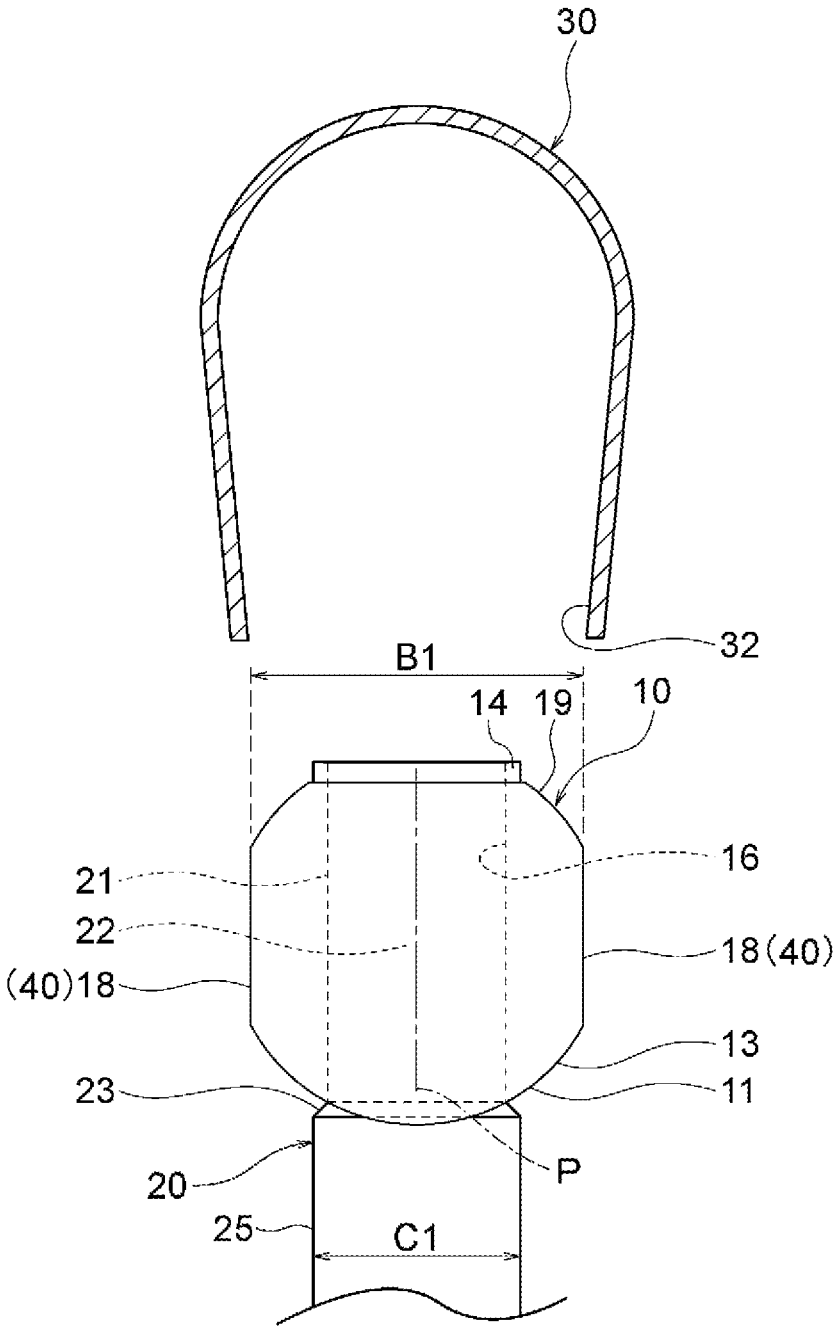

[FIG. 14]
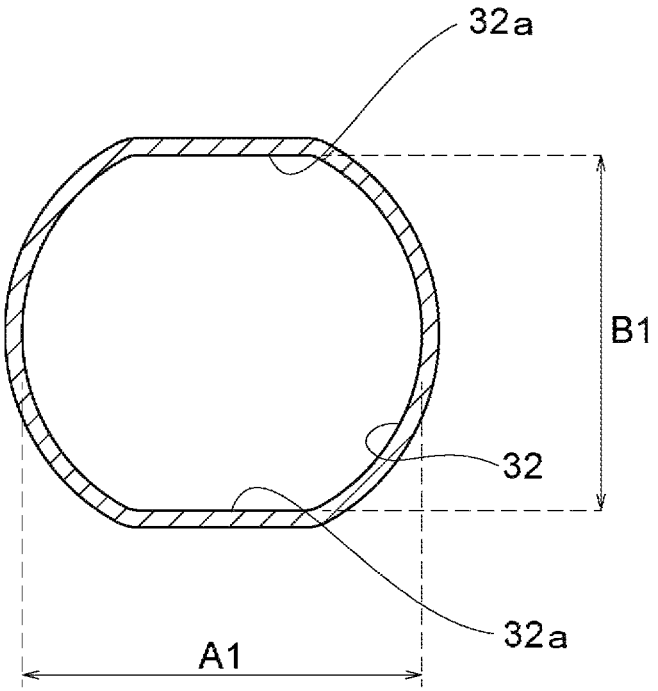

[FIG. 15]
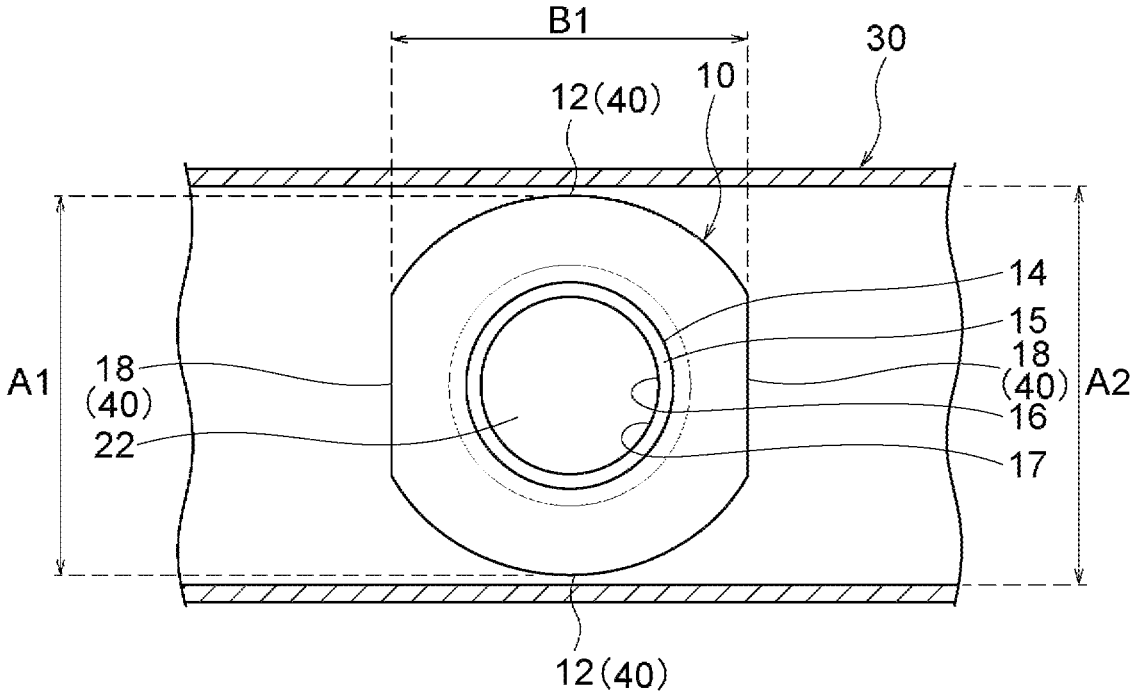

[FIG. 16]
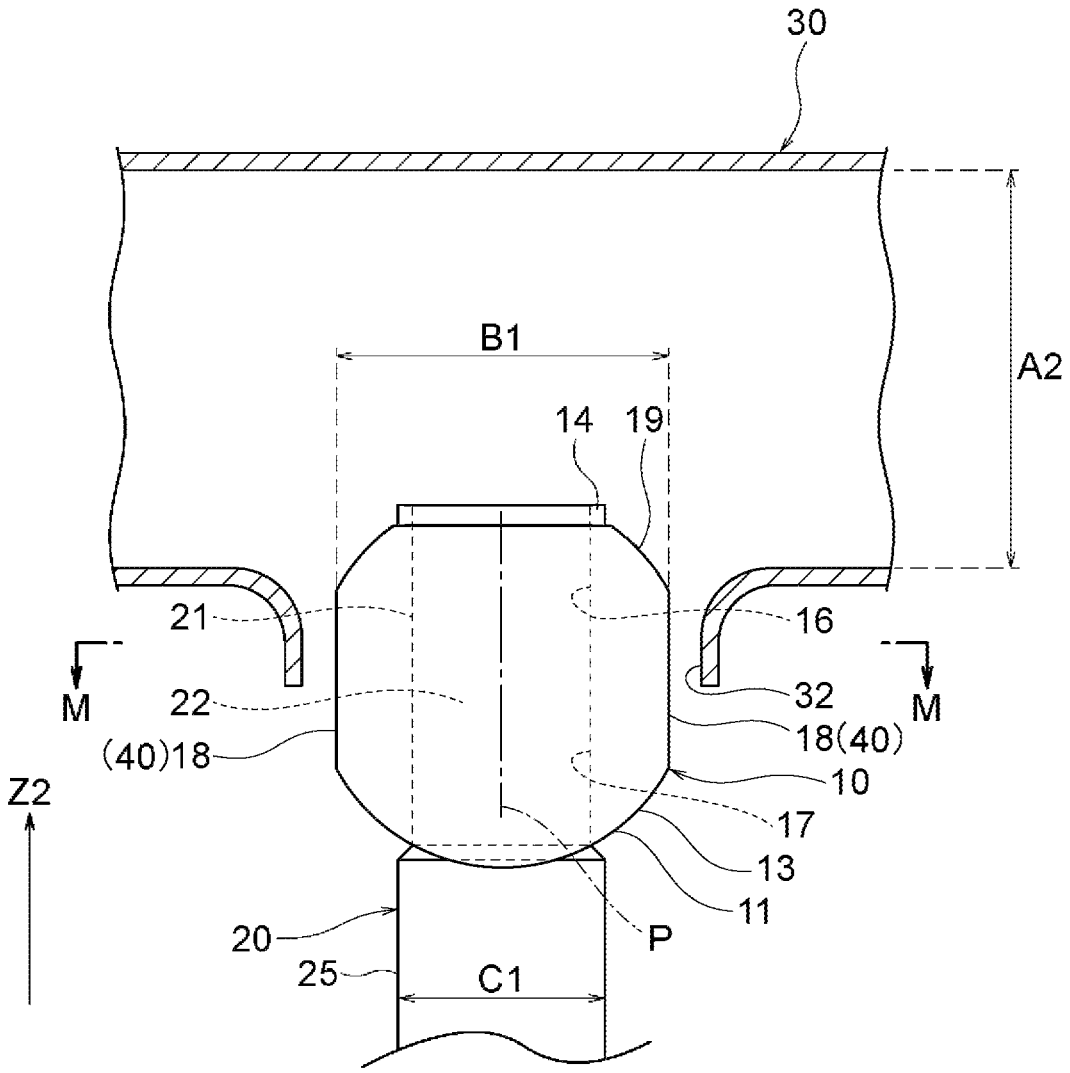

[FIG. 17]
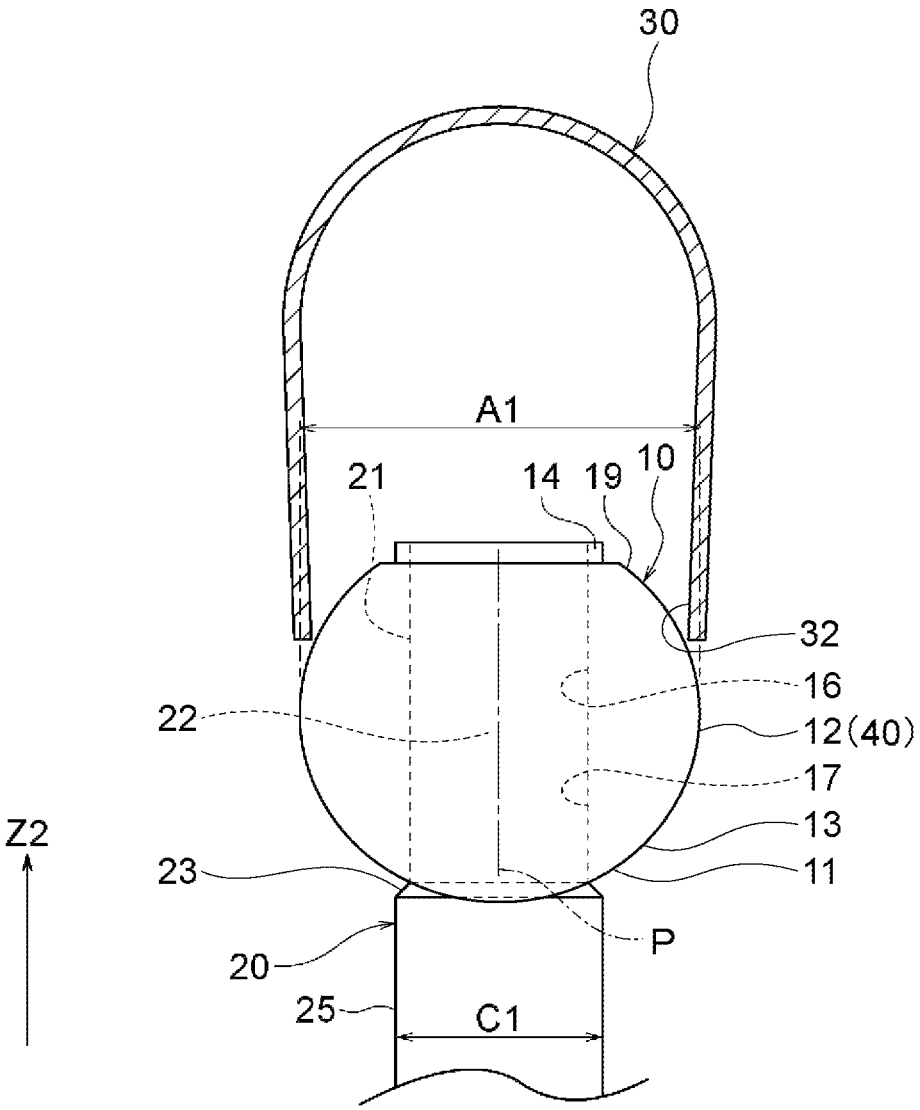

[FIG. 18]
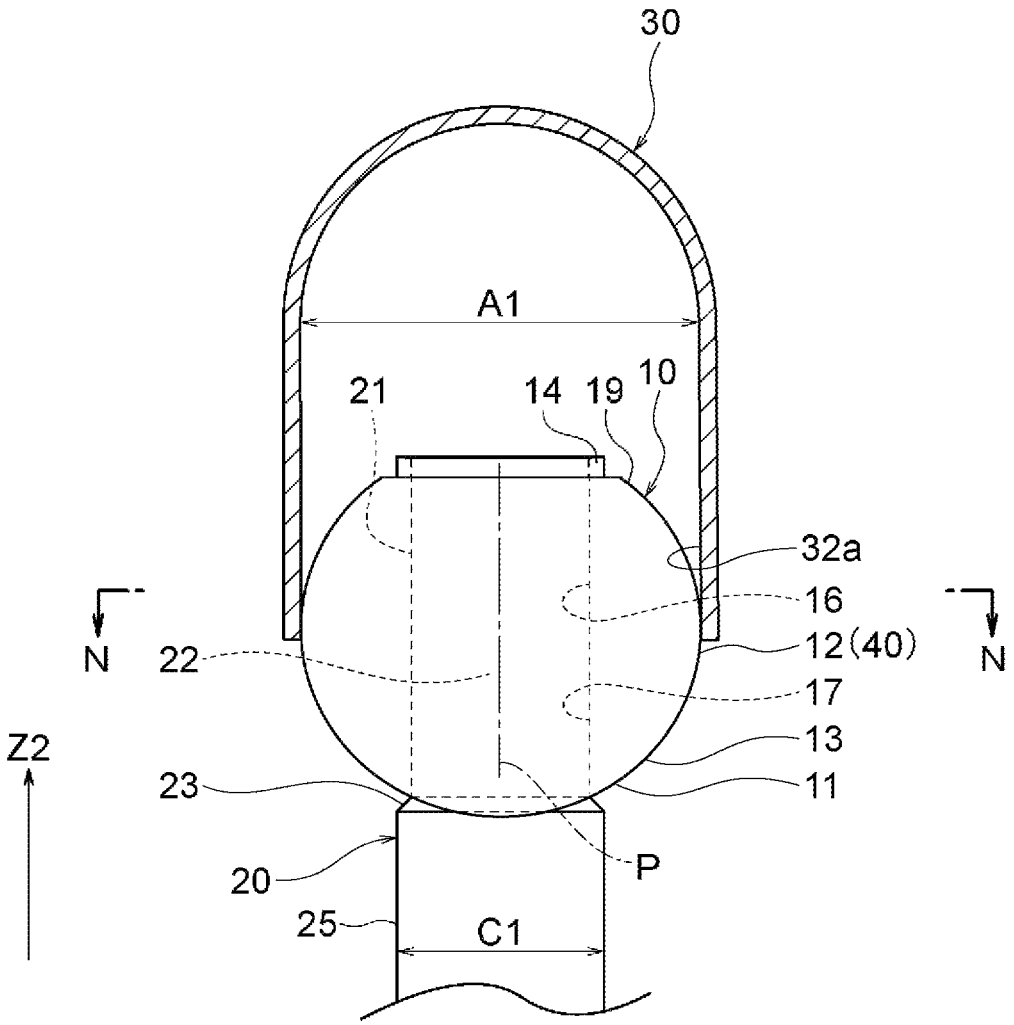

[FIG. 19]
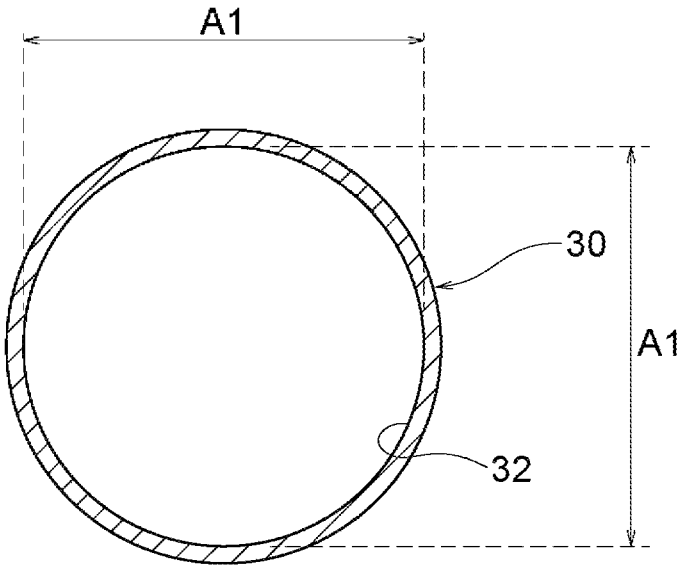

[FIG. 20]
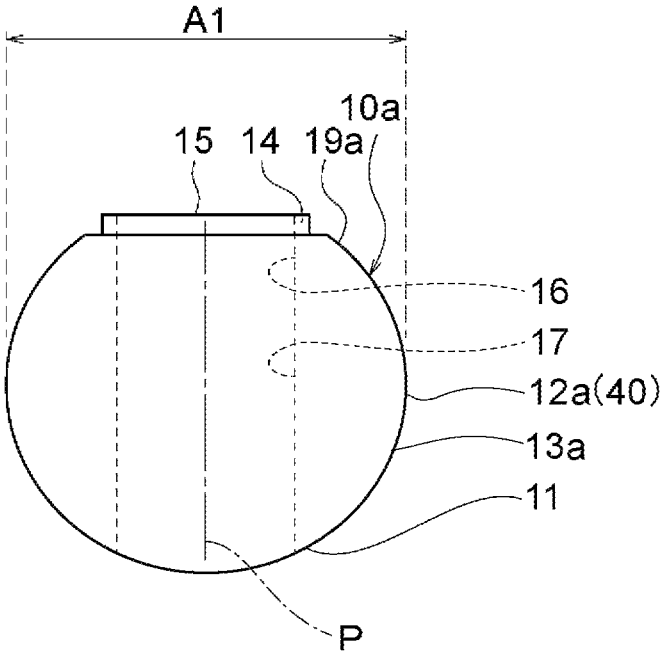

[FIG. 21]
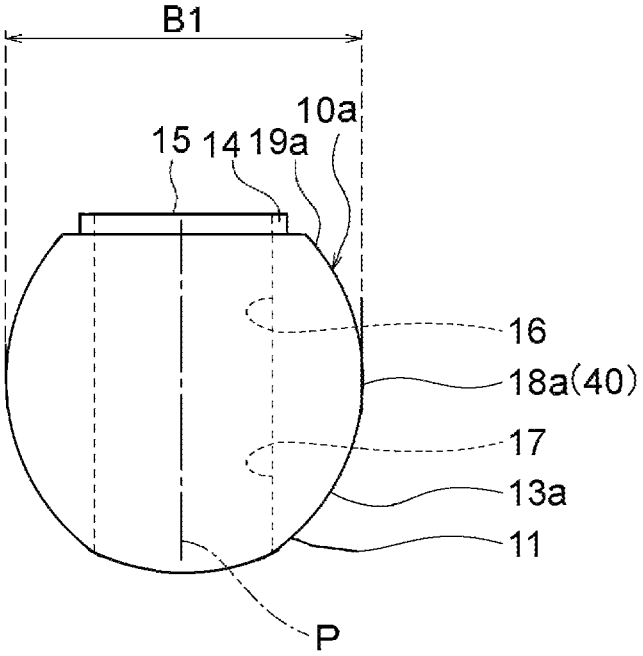

[FIG. 22]
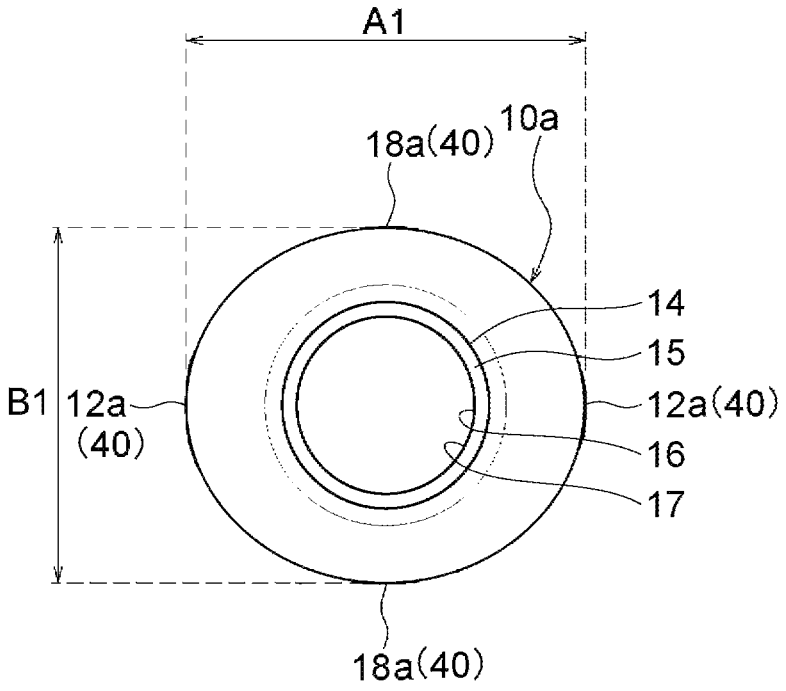

[FIG. 23]
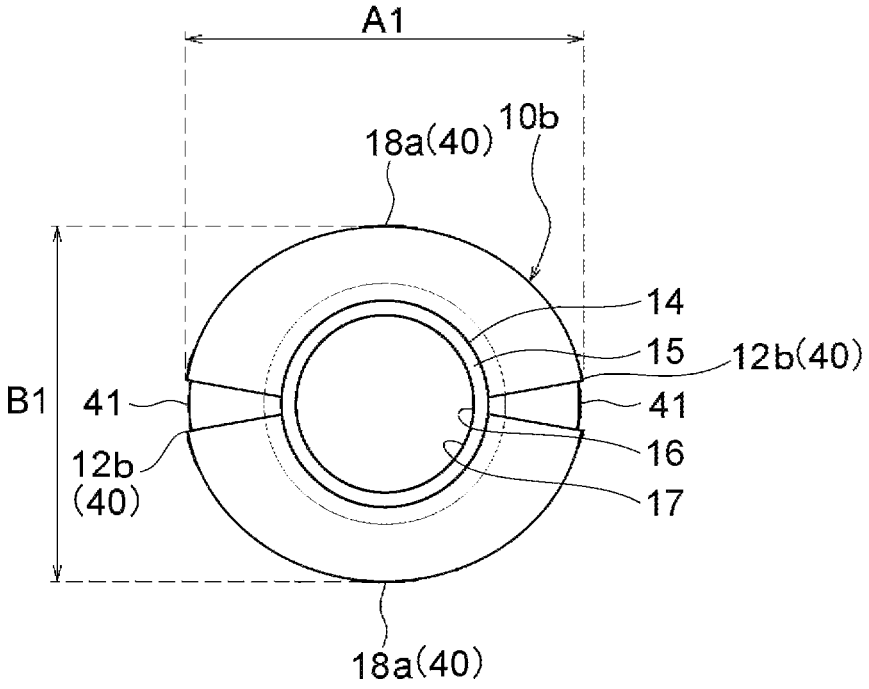

APPARATUS FOR PRODUCING BRANCH STRUCTURE IN METAL PIPE, AND METHOD FOR PRODUCING BRANCH STRUCTURE IN METAL PIPE

CROSS-REFERENCE TO RELATED APPLICATIONS

This application is a U.S. national stage entry under 35 U.S.C. § 371 of PCT International Patent Application No. PCT/JP2021/045805, filed Dec. 13, 2021, which claims priority to Japanese Patent Application No. 2020-212411, filed Dec. 22, 2020, the contents of each of which are hereby incorporated by reference in their entirety.

TECHNICAL FIELD

The present invention relates to an apparatus for producing a branch structure in a metal pipe, and a method for producing a branch structure in a metal pipe.

BACKGROUND ART

For instance the apparatus for producing a branch structure in a metal pipe disclosed in Patent Literature 1 is known as an apparatus for producing a branch structure, in the production of branch structures in metal pipes used for instance various piping applications. In the apparatus for producing a branch structure disclosed in Patent Literature 1, a pilot hole is machined in a metal pipe, and flanging is performed in which a spherical die having been inserted into the pipe is extracted from the interior thereof to the exterior at the site where the pilot hole had been machined, so that a branch-side pipe is caused to branch from the main pipe. That is, the pipe diameter of the branch-side pipe is determined by the diameter of the spherical die.

CITATION LIST

Patent Literature

[PTL 1] Japanese Patent Application Publication No. 2016-209889

SUMMARY OF INVENTION

Technical Problem

In the apparatus for producing a branch structure of Patent Literature 1, however, it is difficult to insert the spherical die into the main pipe when the diameter of the die is identical to the diameter of the main pipe. Accordingly, a problem arises in that it is difficult to carry out flanging so that the pipe diameter of the branch-side pipe and the pipe diameter on the main pipe side are identical.

The present invention has been made in order to solve such a problem, and the object thereof is to provide an apparatus for producing a branch structure in a metal pipe, and a method for producing a branch structure in a metal pipe that allow producing a branch structure having a branch-side pipe, the diameter of which is identical to the pipe diameter of a metal pipe on a main pipe side.

Solution to Problem

In order to solve the above problem, an apparatus for producing a branch structure in a metal pipe, according to the present invention, has: a die having a spherical shape, and having a central axis, and moreover having a first diameter and a second diameter, which is shorter than the first diameter, extending in a direction perpendicular to a direction in which the central axis extends; and a connecting member that can be connected to the die, wherein at a time when the die having been inserted into the metal pipe is to be removed to outside of a metal pipe by the connecting member connected to the die, first flanging is performed by the die on a pilot hole that is formed at a branch portion formation position in the metal pipe and that runs radially through a body of the metal pipe; and the connecting member causes the removed die to rotate by a predetermined angle about the central axis, and second flanging is performed on the pilot hole, from outside the metal pipe by the rotated die.

The die may be a truncated sphere having a pair of opposing flat portions that extend parallelly to the central axis.

The die may be of ellipsoidal shape.

For the purpose of solving the above problem, a method for producing a branch structure in a metal pipe according to the present invention has: a first step of forming a pilot hole that runs radially through a body of a metal pipe, at a branch portion formation position of the metal pipe; a second step of inserting, into the metal pipe, a die having a spherical shape, and having a central axis, and moreover having a first diameter and a second diameter, which is shorter than the first diameter, extending in a direction perpendicular to a direction in which the central axis extends, and of moving the die to a position of the pilot hole; a third step of performing first flanging on the pilot hole, by the die, at the time of removal of the die to outside of the metal pipe; and a fourth step of rotating orientation of the die about the central axis by a predetermined angle, and performing second flanging on the pilot hole, by the die, from outside the metal pipe.

The method may further have, between the second step and the third step, a fifth step of inserting a connecting member into the pilot hole and connecting the die and the connecting member; wherein the third step is carried out by pulling out the connecting member connected to the die, outward in a radial direction of the metal pipe; and the fourth step is carried out by rotating the connecting member connected to the die about the central axis by a predetermined angle, and by pushing the connecting member inward in the radial direction of the metal pipe.

Advantageous Effects of Invention

In the apparatus for producing a branch structure in a metal pipe and the method for producing a branch structure in a metal pipe according to the present invention, first flanging is performed on a pilot hole that runs radially through the body of a metal pipe, by a die of spherical shape having a first diameter, and a second diameter shorter than the first diameter, extending in a direction perpendicular to the direction in which a central axis extends; the die is removed to the exterior of the metal pipe, the removed die is caused to rotate about the central axis by a predetermined angle, and second flanging is performed on the pilot hole, from outside the metal pipe, by the rotated die; as a result it becomes possible to produce a branch structure having a branch-side pipe the diameter of which is identical to the pipe diameter of a metal pipe on a main pipe side.

BRIEF DESCRIPTION OF DRAWINGS

FIG. 1 is a front-view diagram of a die of an apparatus for producing a branch structure of Embodiment 1 of the present invention.

FIG. 2 is a right side-view diagram of a die of the apparatus for producing a branch structure of Embodiment 1 of the present invention.

FIG. 3 is a plan-view diagram of a die of the apparatus for producing a branch structure of Embodiment 1 of the present invention.

FIG. 4 is a front-view diagram of an extraction jig of the apparatus for producing a branch structure of Embodiment 1 of the present invention.

FIG. 5 is a front-view cross-sectional diagram illustrating a step of forming a pilot hole in a branch structure of a metal pipe in Embodiment 1 of the present invention.

FIG. 6 is a front-view diagram illustrating, in a partial cross section, a die insertion step of a method for producing a branch structure in a metal pipe of Embodiment 1.

FIG. 7 is a front-view diagram illustrating, in a partial cross section, an extraction jig joining step of the method for producing a branch structure in a metal pipe of Embodiment 1 of the present invention.

FIG. 8 is a right side-view diagram illustrating a partial cross section of the pipe depicted in FIG. 7.

FIG. 9 is a plan-view cross-sectional diagram of the pipe of FIG. 7 cut along line L-L.

FIG. 10 is a front-view diagram illustrating, in a partial cross section, a first flanging step of the method for producing a branch structure in a metal pipe of Embodiment 1 of the present invention.

FIG. 11 is a right side-view diagram illustrating, in a partial cross section, a first flanging step of the method for producing a branch structure in a metal pipe of Embodiment 1 of the present invention.

FIG. 12 is a front-view diagram illustrating, in a partial cross section, the state after a first flanging step of the method for producing a branch structure in a metal pipe of Embodiment 1 of the present invention.

FIG. 13 is a right side-view diagram illustrating a partial cross section of the pipe depicted in FIG. 12.

FIG. 14 is a plan-view cross-sectional diagram of a flanged portion of the pipe illustrated in FIG. 12, cut along line M-M.

FIG. 15 is a plan-view diagram illustrating, in a partial cross section, a die rotation step of the method for producing a branch structure in a metal pipe of Embodiment 1 of the present invention.

FIG. 16 is a front-view diagram illustrating, in a partial cross section, a second flanging step of the method for producing a branch structure in a metal pipe of Embodiment 1 of the present invention.

FIG. 17 is a right side-view diagram illustrating a partial cross section of the pipe depicted in FIG. 16.

FIG. 18 is a right side-view diagram illustrating, in a partial cross section, a second state of a second flanging step of the method for producing a branch structure in a metal pipe of Embodiment 1 of the present invention.

FIG. 19 is a plan-view cross-sectional diagram of a flanged portion of the pipe illustrated in FIG. 18, cut along line N-N.

FIG. 20 is a front-view diagram of a die of Embodiment 2 of the present invention.

FIG. 21 is a right side-view diagram of the die illustrated in FIG. 20.

FIG. 22 is a plan-view diagram of the die illustrated in FIG. 20.

FIG. 23 is a plan-view diagram of a die of Embodiment 3 of the present invention.

DESCRIPTION OF EMBODIMENTS

Embodiment 1

An apparatus for producing a branch structure of Embodiment 1 of the present invention will be explained below with reference to FIG. 1 to FIG. 4 of the accompanying drawings. FIG. 1 is a front-view diagram of the die of the apparatus for producing a branch structure according to the present Embodiment 1. The die 10 is a die made up of a metal such as a stainless steel alloy, special steel, tool steel or the like, the die being formed to a substantially spherical shape, and having a largest diameter portion 12 with a maximum value of diameter between a front portion 11 and a rear portion 14. The diameter of the largest diameter portion is referred to as long diameter A1. The direction in which the long diameter A1 extends, i.e. the direction from the left to the right in FIG. 1, will be referred to as left-right direction of the die 10. A rear flat portion 15 is formed in the rear portion 14. A front curved surface portion 13 is formed between the front portion 11 and the largest diameter portion 12, and a rear curved surface portion 19 is formed between the rear portion 14 and the largest diameter portion 12. A through-hole 16 extending from the front portion 11 to the rear portion 14 is further formed in the die 10. That is, the through-hole 16 extends in a direction perpendicular to the long diameter A1. As will explained in detail further on, in flanging by the die 10 the front portion 11 faces in a frontward direction and the rear portion 14 in a rearward direction, and accordingly the direction in which the through-hole 16 extends will be referred to as front-rear direction. A threaded portion 17 is formed on the inner peripheral surface of the through-hole 16.

FIG. 2 is a right side-view diagram of the die 10 of the apparatus for producing a branch structure according to the present Embodiment 1, and FIG. 3 is a plan-view diagram of the die 10 of the apparatus for producing a branch structure according to the present Embodiment 1. Smallest diameter portions 18 are provided in the die 10, between the front portion 11 and the rear portion 14. Each smallest diameter portion 18 is a flat portion formed through notching, parallelly to the direction in which a central axis P extends, of part of one outer diameter portion of the substantially spherical die 10 and part of the other outer diameter portion that opposes the former. The distance between one smallest diameter portion 18 and the other smallest diameter portion 18 will be referred to as short diameter B1. The largest diameter portion 12 (see FIG. 1) and the smallest diameter portions 18 constitute a central portion 40 of the die 10 in the front-rear direction.

FIG. 4 is a front-view diagram of an extraction jig 20 of the apparatus for producing a branch structure according to the present Embodiment 1. The extraction jig 20 has a cylindrical tip portion 21, for instance formed of a metal such as a stainless steel alloy, special steel or tool steel, a cylindrical body portion 25 of larger diameter than the diameter of the tip portion 21, and a taper portion 23 that connects the tip portion 21 and the body portion 25. A jig threaded portion 22 that can be screwed onto the threaded portion 17 (see FIG. 1) of the die 10 is formed at the tip portion 21. The diameter of the body portion 25 will be referred to as a jig diameter C1. The extraction jig 20 constitutes a connecting member.

A method for producing a branch structure in a metal pipe according to Embodiment 1 of the present invention will be explained next with reference to FIG. 5 to FIG. 19.

FIG. 5 is a front-view cross-sectional diagram illustrating a step of forming a pilot hole in the method for producing a method for producing a branch structure in a metal pipe of the present Embodiment 1. A pipe 30 is a metal-made pipe configured out of any metal, such as a stainless steel alloy, special steel or tool steel, used for piping of various fluids. FIG. 5 illustrates a cross section of the pipe 30 cut along the central portion of the inner diameter in the longitudinal direction of the pipe. The size of the inner diameter of the pipe 30 will be referred to as a pipe inner diameter A2. Firstly, a known pre-drilling machine, not shown, forms an oval spline-shaped pilot hole 31 that connects the interior and the exterior of the pipe 30, at the site where the branch structure of the pipe 30 is to be produced. The long-axis length of the pilot hole 31 will be referred to herein as long axis length C2. The die 10 is formed so that the long diameter A1 thereof (see FIG. 1) has a length substantially identical to that of the pipe inner diameter A2 of the pipe 30, although the length of the long diameter A1 is slightly smaller. Also, the jig diameter C1 (see FIG. 4) of the body portion 25 of the extraction jig 20 is formed to a length smaller than the long axis length C2.

FIG. 6 is a front-view diagram illustrating, in partial cross section, a die insertion step of the method for producing a branch structure in a metal pipe of the present Embodiment 1, with the pipe 30 depicted in a cross section similar to that of FIG. 5. The die 10 is inserted into the pipe 30, and is moved to a position at which the pilot hole 31 has been formed. Herein the die 10 is inserted so that the extension direction of the through-hole 16 of the die 10 and the extension direction of the pilot hole 31 match each other, and the radial-direction centers of the through-hole 16 and of the pilot hole 31 likewise match each other. At this time the die 10 is inserted so that the largest diameter portion 12 of the die 10 is provided opposing the pipe 30 in a direction perpendicular to the longitudinal direction of the pipe 30 in the longitudinal direction, and so that the smallest diameter portions 18, i.e. oppose the inner surface of the pipe 30.

FIG. 7 is a front-view diagram illustrating, in a partial cross section, an extraction jig joining step of the method for producing a branch structure in a metal pipe of the present Embodiment 1. The tip portion 21 of the extraction jig 20 is inserted from outside into the pilot hole 31 of the pipe 30. The tip portion 21 inserted into the pipe 30 is inserted into the through-hole 16 of the die 10. The jig threaded portion 22 of the tip portion 21 and the threaded portion 17 of the through-hole 16 of the die 10 are screwed together, whereupon the tip portion 21 of the extraction jig 20 becomes joined to the die 10 as a result.

FIG. 8 is a right side-view diagram illustrating a partial cross section of the pipe 30 depicted in FIG. 7. The front curved surface portion 13 and the rear curved surface portion 19 of the die 10 substantially hug the inner curved surface of the pipe 30. FIG. 9 is a plan-view cross-sectional diagram of the pipe 30 of FIG. 7 cut along line L-L. With reference to FIG. 8 and FIG. 9, the short diameter B1 of the smallest diameter portions 18 of the die 10 is smaller than the pipe inner diameter A2 of the pipe 30, such that a gap 33 is formed between each smallest diameter portion 18 and the inner curved surface of the pipe 30. As compared with a hypothetical case in which the die 10 having a substantially spherical shape with no smallest diameter portions 18 is used, the die 10 of the present embodiment is inserted readily into the pipe 30, even if the long diameter A1 of the die 10 and the pipe inner diameter A2 of the pipe 30 are substantially identical, thanks to the fact that the gaps 33 in the die 10 are formed between the smallest diameter portions 18 and the inward surface of the pipe 30.

FIG. 10 is a front-view diagram illustrating, in a partial cross section, a first flanging step of the method for producing a branch structure in a metal pipe of the present Embodiment 1, and FIG. 11 is a right side-view diagram illustrating the same, in a partial cross section. A known flanging machine, not shown, extracts the extraction jig 20 radially outward along the extension direction of the pilot hole 31 of the pipe 30, i.e. in the direction of arrow Z1. As a result, the edge of the pilot hole 31 (see FIG. 7) is pulled out in the direction of arrow Z1 by the front curved surface portion 13 of the die 10 joined to the extraction jig 20, and the die 10 is extracted in the direction of arrow Z1 while forming a flanged portion 32.

FIG. 12 is a front-view diagram illustrating, in a partial cross section, the state after the first flanging step of the method for producing a branch structure in a metal pipe of the present Embodiment 1. Upon removal of the die 10 from the pipe 30, the flanged portion 32 is pushed wide by the largest diameter portion 12 of the die 10, along the longitudinal direction of the pipe 30, whereby an opening becomes formed that has the same length as the long diameter A1. FIG. 13 is a right side-view diagram illustrating a partial cross section of the pipe 30 of FIG. 12. The flanged portion 32 is pushed so as to widen, by the smallest diameter portions 18 of the die 10, in a direction perpendicular to the longitudinal direction of the pipe 30, as a result of which an opening becomes formed that has the same length as the short diameter B1.

FIG. 14 is a plan-view cross-sectional diagram of the flanged portion 32 of the pipe 30 of FIG. 12, cut along line M-M. The flanged portion 32 having the long diameter A1 and the short diameter B1 is formed as an opening having a truncated circular shape, with parts of the circle missing along the straight portions 32*a*.

FIG. 15 is a plan-view diagram illustrating, in a partial cross section, a rotation step of the die 10 in the method for producing a branch structure in a metal pipe of the present Embodiment 1. A flanging machine, not shown, rotates the extraction jig 20 (see FIG. 12) clockwise by 90 degrees, to thereby rotate the die 10 clockwise by 90 degrees. As a result, the largest diameter portion 12 of the die 10 becomes positioned perpendicularly to the longitudinal direction of the pipe 30, i.e. facing the inner surface of the pipe 30, while the smallest diameter portions 18 of the die 10 becomes positioned facing the longitudinal direction of the pipe 30.

FIG. 16 is a front-view diagram illustrating, in a partial cross section, a second flanging step of the method for producing a branch structure in a metal pipe of the present Embodiment 1, and FIG. 17 is a right side-view diagram illustrating a partial cross section of the pipe 30 illustrated in FIG. 16. A flanging machine, not shown, moves the extraction jig 20 towards the interior of the pipe 30, i.e. in the direction of arrow Z2. The extraction jig 20 moves thereupon in the direction of arrow Z2, as a result of which the die 10 becomes inserted again into the flanged portion 32.

FIG. 18 is a right side-view diagram illustrating, in a partial cross section, a second state of the second flanging step illustrated in FIG. 17. Upon further insertion of the die 10 into the pipe 30 as a result of the displacement of the extraction jig 20 in the direction of arrow Z2, the straight portions 32*a* come into contact with the largest diameter portion 12, from the rear curved surface portion 19 of the die 10, and are thereby pushed apart from each other. The opposing straight portions 32*a* are pushed apart until the distance between the straight portions 32*a* is identical to the long diameter A1, which is the length of the largest diameter portion 12.

FIG. 19 is a plan-view cross-sectional diagram of the flanged portion 32 illustrated in FIG. 18, cut along line N-N. The straight portions 32*a* (see FIG. 18) are pushed apart until the distance therebetween becomes identical to the long diameter A1; as a result, the inner diameter of the flanged portion 32 (see FIG. 16) along the longitudinal direction of the pipe 30, and the inner diameter of the flanged portion 32 along the radial direction of the pipe 30, both become the long diameter A1. That is, the flanged portion 32 is formed to a circular shape the diameter whereof is identical to the long diameter A1. Next, a flanging machine, not shown, extracts the extraction jig 20 and the die 10 out of the pipe 30; this completes the flanging of the flanged portion 32, which is the branch-side pipe of the branch structure of the pipe 30.

Thus, the apparatus for producing a branch structure according to the present Embodiment 1 has the die 10 of spherical shape, having the central axis P, and having the long diameter A1 and the short diameter B1, which is shorter than the long diameter A1, extending in a direction in which the central axis P extends; and an extraction jig 20 that can be connected to the die 10, wherein at the time of removal, by the extraction jig 20 having the die 10 connected thereto, of the die 10 having been inserted into the pipe 30 in which the flanged portion 32 is to be formed, first flanging is performed by the die on the pilot hole 31 that has been formed at a branch portion formation position in the pipe 30 and that runs radially through the body of the pipe 30, and then the extraction jig 20 causes the removed die 10 to rotate by a predetermined angle about the central axis, whereupon second flanging is performed on the pilot hole 31, from outside the pipe 30, by the rotated die 10; as a result, it becomes possible to produce a branch structure having a flanged portion 32 which is a branch-side pipe and has the same diameter as the diameter of the pipe 30 on a main pipe side.

The die 10 is a truncated sphere having a pair of smallest diameter portions 18 that extend parallelly to a central axis P, and accordingly a spherical die 10 having the long diameter A1 and the short diameter B1 can be formed by resorting to simple machining.

As described above, the method for producing a branch structure in a metal pipe according to the present Embodiment 1 has a first step of forming the pilot hole 31 that runs radially through the body of the pipe 30, at the branch portion formation position of the pipe 30; a second step of inserting, into the pipe 30, the die 10 of spherical shape, having the central axis P and having the long diameter A1 and the short diameter B1, which is shorter than the long diameter A1, extending in a direction in which the central axis P extends and of moving the die 10 to the position of the pilot hole 31; a third step of performing first flanging on the pilot hole, by the die 10, at the time of removal of the die 10 to the exterior the pipe 30; a fourth step of rotating the orientation of the die 10 about the central axis by a predetermined angle, and performing second flanging on the pilot hole 31, by the die 10, from outside the pipe 30; as a result, it becomes possible to produce a branch structure having the flanged portion 32 which is a branch-side pipe and has the same diameter as the diameter of the pipe 30 on a main pipe side.

The method is also a method for producing a branch structure in a metal pipe, further having, between the second step and the third step, a fifth step of inserting the extraction jig 20 into the pilot hole 31 and connecting the die 10 and the extraction jig 20, wherein the third step is carried out through pulling of the extraction jig 20 connected to the die 10, outward in the radial direction of the pipe 30, and the fourth step is carried out by rotating the extraction jig 20 connected to the die 10 about a central axis by a predetermined angle, and by pushing the extraction jig 20 inward in the radial direction of the pipe; as a result it becomes possible to perform first flanging of pulling out the die 10 from inside the pipe 30, and second flanging of pushing the die 10 into the pipe 30, by resorting to a simple configuration.

Embodiment 2

An apparatus for producing a branch structure of Embodiment 2 of the present invention will be explained next with reference to FIG. 20, FIG. 21 and FIG. 22. In the embodiment below, reference numerals identical to those of FIG. 1 to FIG. 19 will denote constituent elements identical or similar to those in Embodiment 1, and hence a detailed explanation thereof will be omitted. The apparatus for producing a branch structure of Embodiment 2 is obtained by modifying the shape of the die of the Embodiment 1 from a truncated sphere shape to an ellipsoidal shape.

FIG. 20 is a front-view diagram of a die 10*a* of Embodiment 2. The die 10*a* has a largest diameter portion 12*a*, a front curved surface portion 13*a*, and a rear curved surface portion 19*a*. FIG. 21 is a right side-view diagram of the die 10*a* illustrated in FIG. 20, and FIG. 22 is a plan-view diagram of the die 10*a* illustrated in FIG. 20. The die 10*a* is formed to an ellipsoidal shape having a largest diameter portion 12*a*, and a smallest diameter portion 18*a* that is formed at a position circumferentially rotated by 90 degrees, about the central axis P, with respect to the largest diameter portion 12*a*. The diameter of the largest diameter portion 12*a* is the long diameter A1. The diameter of the smallest diameter portion 18*a* is the short diameter B1. Other features are identical to those of Embodiment 1.

The die 10*a*, although of ellipsoidal shape, has thus a long diameter A1 and a short diameter B1 in a direction perpendicular to the central axis P, similarly to Embodiment 1, and accordingly it becomes possible to produce a branch structure having a flanged portion 32 which is a branch-side pipe and has the same diameter as the diameter of the pipe 30 on the main pipe side, similarly to Embodiment 1.

Embodiment 3

An apparatus for producing a branch structure of Embodiment 3 of the present invention will be explained next with reference to FIG. 23. In Embodiment 3, reference numerals identical to those of FIG. 20 to FIG. 22 will denote constituent elements identical or similar to those in Embodiment 2, and a detailed explanation thereof will be omitted. The apparatus for producing a branch structure of Embodiment 3 is obtained by modifying the shape of the largest diameter portion 12*a* of the die 10*a* of Embodiment 2.

FIG. 23 is a plan-view diagram of a die 10*b* of the present Embodiment 3. Notch portions 41 are formed at positions rotated in the circumferential direction by 90 degrees, about the through-hole 16, with respect to the smallest diameter portion 18*a* of the die 10*b*. The notch portions 41 are formed along the outer periphery of the die 10*b*, from the front portion to the rear portion 14 of the die 10*b*. Largest diameter portions 12*b* of the die 10*b* are formed at positions on either side of the notch portions 41 in the central portion 40. The distance from one largest diameter portion 12*b* to the other largest diameter portion 12*b* across the through-hole 16 is the long diameter A1. Other features are identical to those of Embodiment 2.

The die 10*b*, even though being of ellipsoidal shape and having notch portions 41 formed along the outer periphery, has the long diameter A1 and the short diameter B1 in a direction perpendicular to the central axis, similarly to Embodiment 1, and accordingly it becomes possible to produce a branch structure having a flanged portion 32 which is a branch-side pipe and has the same diameter as the diameter of the pipe 30 on the main pipe side, similarly to Embodiment 1.

The shapes of the dies 10, 10*a* and 10*b* have been explained in Embodiments 1 and 2 of the present invention, but these shapes are illustrative in nature, and the invention is not limited thereto. The length of the largest diameter portions in the dies 10, 10*a* and 10*b* is the long diameter A1, and is substantially identical to the pipe inner diameter A2 of the pipe 30. However, the long diameter A1 of the dies 10, 10*a* and 10*b* may be of another arbitrary length, so long as it is no greater than the length of the pipe inner diameter A2 of the pipe 30.

In Embodiments 1 and 2 of the present invention, the dies 10, 10*a*, 10*b* and the extraction jig 20 are made up of a metal such as a stainless steel alloy, special steel or tool steel, but may be made up of another arbitrary metal. Also, the pipe 30 is made up of a metal such as a stainless steel alloy, special steel or tool steel, but may be made up of another arbitrary metal, such as copper.

In Embodiments 1 and 2 of the present invention, the long diameter A1 and the short diameter B1 of the dies 10, 10*a* and 10*b* intersect perpendicularly, but the shapes of the dies 10, 10*a* and 10*b* are not limited thereto. In Embodiments 1 and 2 of the present invention, the dies 10, 10*a* and 10*b* are rotated by 90 degrees rotation after the first flanging step, but in a case where the long diameter A1 and the short diameter B1 of the dies 10, 10*a* and 10*b* do not intersect perpendicularly, a method may be adopted in which the angle by which the dies 10, 10*a* and 10*b* are rotated after the first flanging step is modified as appropriate in accordance with the angle between the long diameter A1 and the short diameter B1.

REFERENCE SIGNS LIST

10, 10*a*, 10*b* Die
18 Smallest diameter portion (flat portion)
20 Extraction jig (connecting member)
30 Pipe (metal pipe)
31 Pilot hole
A1 long diameter (first diameter)
B1 Short diameter (second diameter)
P Central axis

The invention claimed is:

1. An apparatus for producing a branch structure in a metal pipe, the apparatus comprising:

a die having a spherical shape, and having a central axis, and moreover having a first diameter and a second diameter, which is shorter than the first diameter, extending in a direction perpendicular to a direction in which the central axis extends; and a connecting member that can be connected to the die;

the die having a front curved surface portion, a largest diameter portion and a rear curved surface portion provided in this order along the direction in which the central axis extends;

wherein at a time when the die having been inserted into the metal pipe is to be removed to outside of a metal pipe by the connecting member connected to the die, first flanging is performed by the front curved surface portion on a pilot hole that is formed at a branch portion formation position in the metal pipe and that runs radially through a body of the metal pipe, and the connecting member causes the removed die to rotate by a predetermined angle about the central axis and inserting the die to the first flanged pilot hole, whereupon second flanging is performed on the first flanged pilot hole, from outside the metal pipe by the rotated rear curved surface portion.

2. The apparatus for producing a branch structure in a metal pipe according to claim 1, wherein the die is a truncated sphere having a pair of opposing flat portions that extend parallelly to the central axis.

3. The apparatus for producing a branch structure in a metal pipe according to claim 1, wherein the die has an ellipsoidal shape.

4. A method for producing a branch structure in a metal pipe, the method comprising:

a first step of forming a pilot hole that runs radially through a body of a metal pipe, at a branch portion formation position of the metal pipe;

a second step of inserting, into the metal pipe, a die having a spherical shape, and having a central axis, and moreover having a first diameter and a second diameter, which is shorter than the first diameter, extending in a direction perpendicular to a direction in which the central axis extends, and of moving the die to a position of the pilot hole;

a third step of performing first flanging on the pilot hole, by the die, at a time of removal of the die to outside of the metal pipe; and a fourth step of rotating orientation of the die about the central axis by a predetermined angle, and performing second flanging on the pilot hole, by the die, from outside the metal pipe.

5. The method for producing a branch structure in a metal pipe according to claim 4, further comprising:

a fifth step of, between the second step and the third step, inserting a connecting member into the pilot hole and connecting the die and the connecting member, wherein the third step is carried out through pulling of the connecting member connected to the die, outward in a radial direction of the metal pipe; and the fourth step is carried out by rotating the connecting member connected to the die about the central axis by a predetermined angle, and by pushing the connecting member inward in the radial direction of the metal pipe.

* * * * *